US005937880A

United States Patent [19]

Payzant

[11] Patent Number: 5,937,880

[45] Date of Patent: Aug. 17, 1999

[54] UNDER COUNTER DISH WASHING MACHINE

[75] Inventor: Russell L. Payzant, Olathe, Kans.

[73] Assignee: TCA, Inc., Kansas City, Kans.

[21] Appl. No.: 08/943,633

[22] Filed: Oct. 3, 1997

[51] Int. Cl.[6] ..... B08B 3/02

[52] U.S. Cl. ..... 134/175; 134/177; 134/181; 210/171; 210/418

[58] Field of Search ..... 134/57 D, 56 D, 134/58 D, 111, 175, 176, 177, 179, 180, 181; 210/171, 418

[56] References Cited

U.S. PATENT DOCUMENTS

| | | | |
|---|---|---|---|
| 2,154,559 | 4/1939 | Bilde . | |
| 2,655,165 | 10/1953 | Low . | |
| 2,667,883 | 2/1954 | Demarest . | |
| 2,808,063 | 10/1957 | Abresch et al. . | |
| 2,891,560 | 4/1959 | Ullman . | |
| 3,077,200 | 2/1963 | Guth . | |
| 3,134,386 | 5/1964 | Jenkins . | |
| 3,179,481 | 4/1965 | Jenkins . | |
| 3,941,153 | 3/1976 | Traube et al. | 137/562 |
| 3,989,054 | 11/1976 | Mercer | 134/104 |
| 4,172,463 | 10/1979 | Woolley et al. | 134/176 |
| 5,368,653 | 11/1994 | Russell | 134/24 |

FOREIGN PATENT DOCUMENTS

| | | | |
|---|---|---|---|
| 1461176 | 12/1965 | France | 134/58 D |
| 406105789 | 4/1994 | Japan | 134/58 D |
| 406277170 | 10/1994 | Japan | 134/57 D |
| 831687 | 3/1960 | United Kingdom | 134/58 D |

*Primary Examiner*—Frankie L. Stinson
*Assistant Examiner*—Paul J. Lee
*Attorney, Agent, or Firm*—Shook, Hardy & Bacon LLP

[57] ABSTRACT

An under counter dish washing machine has an upper spray assembly with a spray base recessed at the top of the wash compartment. An enclosed control housing is provided around the recess to house various controls in order to make use of what is otherwise wasted space. The sump of the machine is covered by a screen having an opening in which a pump filter moves up and down to open and close the drain opening. The filter has a perforated body so that all water draining to the sump must pass through either the screen openings or the perforations of the pump filter. The supply hose which delivers water to the machine is relieved from constant water pressure by a solenoid valve which closes except during a fill cycle of the machine.

6 Claims, 5 Drawing Sheets

UNDER COUNTER DISH WASHING MACHINE

FIELD OF THE INVENTION

This invention relates generally to dish washing machines and more particularly to a dish washing machine of the type installed under counters.

BACKGROUND OF THE INVENTION

Dish washing machines used in restaurants, institutions and other commercial facilities which wash dishes in high volume are available in a variety of different types. One type that is advantageous in many applications is an under counter unit that is installed beneath a counter top. This type of dishwasher has size constraints because of the need to install it under a standard counter top (usually only 34 inches high). As a result, it is important to keep the size of the wash compartment as large as possible in order to avoid unduly limiting the capacity of the machine.

One problem is that the machine must normally be equipped with upper and lower spray arms that necessarily occupy space in the wash compartment. Typically, the upper spray arm is mounted at the top of the cabinet with a spray base that supplies water to it located as high as possible. Because the spray arm is located below the spray base, the spray arm extends downwardly a considerable distance below the top of the wash compartment. Thus, a fairly large amount of essentially wasted space is located at the top of the cabinet above the spray arm. The pumps and controls are usually housed in the bottom of the cabinet below the wash compartment floor. Accordingly, the space required for these components determines the height of the wash compartment floor and thus the height of the lower spray arm.

Dish washing machines of this type are often constructed for operation as batch units. Water collected in the basin or sump of the machine is pumped to the spray arms during a wash cycle, after which the wash water is drained and incoming water is added and pumped to the spray arms for a rinse cycle using clean water. The next machine cycle uses the leftover rinse water for the wash water.

A major problem with this type of batch operated machine is that some of the soiled water does not drain out and is applied with the new rinse water during the rinse cycle. Consequently, the rinse water is partially soiled and the effectiveness of the dish washing suffers. Although measures have been taken to reduce the harmful effects of the leftover water, they have not been entirely successful and have at best achieved inconsistent results.

In order to keep food scraps and other materials from clogging the pump and the spray arms, a pump filter is normally installed in the sump area. While the filter can prevent clogging of the pump and spray arms, food materials become lodged in the pump filter so that the rinse water is drawn through matted soil in the filter and is mixed with the leftover wash water. Clogging of the filter also reduces the flow area available for water to flow to the pump, and operating pressure is lost. In order to minimize this problem, the filter must be removed and cleaned at frequent intervals. At best, this results in significant maintenance requirements and at worst, the filter is not adequately cleaned and the machine is ineffective.

Large items such as broken glass, straws, toothpicks and the like do not affect the quality of the rinse water. Thus, scrap accumulators in the flow path can be provided to collect these types of materials without adverse affects on the machine operation. In an under counter machine, the provision of a scrap accumulator presents unique difficulties. If the accumulator is outside of the sump and cannot be pumped reliably, there is a risk of flooding that may not be detected early enough to avoid serious damage because of the location of the machine beneath the counter. A "closed" accumulator outside of the sump occupies space that could otherwise be used as part of the wash compartment. A gravity flow system with a sealed accumulator reduces the wash compartment size to an even greater extent.

The dishwasher receives water through a flexible hose which normally connects with the building water supply. Typically, the hose is constantly filled with water and is thus continually subjected to water pressure. This constant pressure can result in a hose rupture which can cause serious and costly flooding, especially if it occurs when the building is unoccupied and there is no one to notice and attend to the flooding problem.

SUMMARY OF THE INVENTION

The present invention is directed to an under counter dish washing machine which is improved in a number of respects from the machines that have been available in the past. In particular, the spray base of the upper spray arm is located at a recessed location in order to allow otherwise wasted space at the top of the cabinet to be enclosed and used as a housing for some of the control components. In addition, an improved drain, screen and filter arrangement solves many of the problems that have plagued prior pump filters. Another feature of the invention is the provision of a water manifold that is equipped with an automatic valve for isolating the supply hose from water pressure unless the machine calls for incoming water.

In accordance with the invention, the dishwasher cabinet has a wash compartment that presents a recess at the top for receiving the upper spray base and the plumbing which supplies water to it. This allows some of the controls to be housed in an enclosed compartment at the top of the unit in what is normally wasted space. In turn, the pump housing at the bottom of the unit can be shallower because it is not required to house the components that are contained in the upper housing area.

The sump which collects the water that is used to wash and rinse the dishware is covered by a screen that prevents larger particles from entering the sump. An opening in the screen is occupied by a pump filter which is open at the top, closed at the bottom and provided with perforations on the side. A drain plug on the bottom of the filter normally seats on the drain opening to close it. During the wash and rinse cycles, the drain is closed and the water flows to the pump intake through the perforations on the screen and filter. Due to its location, the filter serves as a scrap box to collect large objects which can be dumped from it when necessary.

The pump filter is automatically lifted from the drain opening during a drain cycle which occurs between each wash cycle and the succeeding rinse cycle. When the pump filter is lifted, the drain is opened to drain away all of the wash water at the end of the wash cycle. The water must still pass through the perforations of either the screen or the filter in order to prevent large objects from entering the sump while allowing suspended soil to drain away.

The water supply system includes a water manifold which is a wall mounted unit. The manifold receives water from the supply pipe which supplies water from the building water supply to the dishwasher. A flexible hose extends from the manifold to an inlet fitting for the machine. The manifold has a solenoid valve which is normally closed to normally shield the supply hose from the building water pressure. Only when the machine calls for water does the solenoid valve open under the control of the machine control system. By virtue of this arrangement, the hose is not subjected to constant water pressure, and the risk of flooding due to hose rupture is virtually eliminated.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 2:
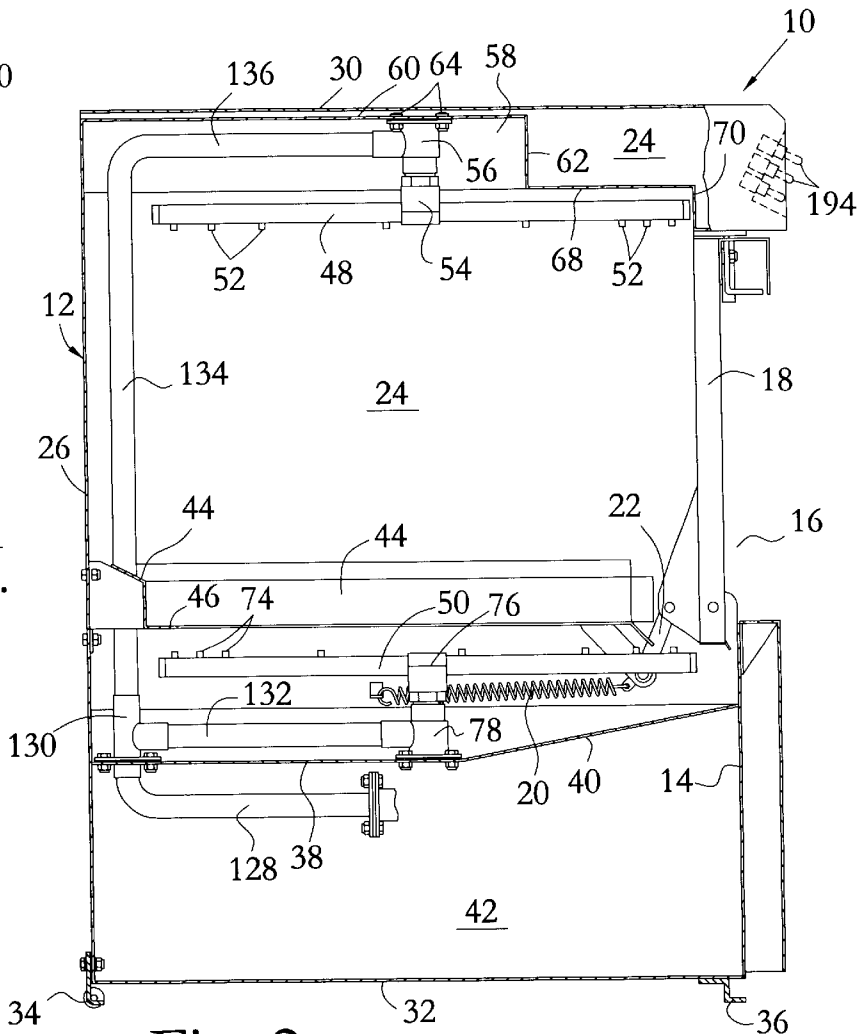
FIG. 2 is an elevational view taken generally along line 2—2 of FIG. 1 in the direction of the arrows.
Figure 1:
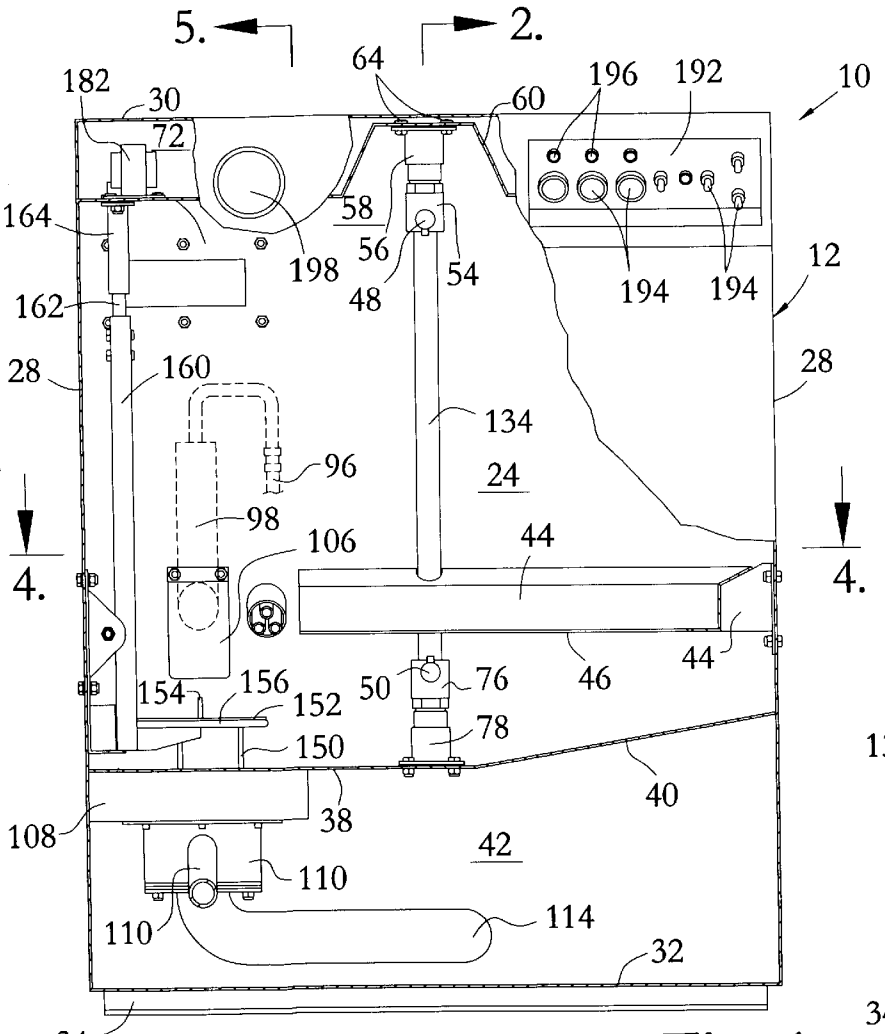
FIG. 1 is a front elevational view of an under counter dish washing machine constructed according to a preferred embodiment of the present invention, with portions broken away for purposes of illustration.

Referring now to the drawings in more detail and initially to FIGS. 1 and 2, numeral 10 generally designates an under counter dish washing machine of the type that may be installed under a counter. The machine 10 has a rectilinear cabinet which is generally identified by numeral 12. The cabinet 12 has a front panel 14 (see FIG. 2) which presents a door opening 16 that is occupied by a hinged door 18 when the door is in the closed position. A tension spring 20 operates through a linkage 22 to urge the door 12 toward the closed position shown in FIG. 2. The door 18 may be pivoted to an open position to expose the door opening 16 so that dishware can be loaded into a wash compartment 24 which is presented within the cabinet 12.

The cabinet 12 has a back panel 26 located at the back of the wash compartment 24 and opposite side panels 28 located on opposite sides of the wash compartment. The cabinet also has a top panel 30 and a bottom panel 32. Cabinet 12 may be provided with rails 34 and 36 which are attached to the bottom panel 32 and which support the dish washing machine within a cabinet or other area located beneath a counter. The back rail 34 may be equipped with wheels to facilitate sliding the cabinet under the counter.

The bottom of the wash compartment 24 is provided by a floor panel having a generally level portion 38 and inclined portions 40 which slope downwardly toward the flat portion 38 in order to direct water toward the flat portion of the floor panel. An enclosed pump compartment 42 is presented between the floor panel of the wash compartment 24 and the bottom panel 32 of the cabinet.

The wash compartment 24 is provided with a plurality of rack supports 44 which are bolted or otherwise suitably secured to the back panel 26 and both of the side panels 28. Each of the rack supports 44 has a projecting lip 46 providing a horizontal ledge on which a dishware rack (not shown) may be supported at a location within the wash compartment. The dish rack contains dishware that is to be washed by the machine.

The dishware is washed and rinsed in the compartment 24 by upper and lower spray arms 48 and 50, respectively. The upper spray arm 48 is provided with a plurality of nozzles 52 which direct water downwardly from the arm 48 toward the underlying dishware. The spray arm 48 extends from a central hub 54 which is mounted for rotation to a spray base 56. The spray base 56 also supplies water through hub 54 to the spray arm 48. The spray base 56 is located within an open bottomed recess 58 which is formed within an inverted channel 60. The recess 58 is centered at a location midway between the side panels 28. The channel 60 extends from the back panel 26 forwardly and terminates at a front plate 62 located rearwardly from the front of the machine. The channel 60 has a flat top panel to which a flange on the spray base 56 is secured by nut and bolt assemblies 64. The spray arm 48 is located immediately below the open bottom of the recess 58.

With particular reference to FIG. 1, the bottom edges of the channel 60 connect with horizontal panels 66 which extend to the opposite side panels 28 of the cabinet. As shown in FIG. 2, the lower edge of the front plate 62 connects with a horizontal panel 68 which terminates at its forward end in a downwardly extending lip 70 located adjacent to the end of the upper spray arm 48. The panels 66 and 68 provide an enclosed chamber or compartment 72 which is used to house various control components, as will be explained more fully. The control compartment 72 is located immediately below the top panel 30 of the cabinet and is enclosed and thus isolated from the wash compartment 24 so that the components contained within the compartment 72 are not exposed to the water and chemicals that are applied to the wash compartment 24.

The lower spray arm 50 is located at a level beneath the rack supports 44. A plurality of spray nozzles 74 are spaced along the length of the spray arm 50 and oriented to direct water upwardly toward the dishware in the wash compartment 24. The lower spray arm 50 has a central hub 76 which is mounted for rotation on a spray base 78 and which supplies water to the spray arm 50 through hub 76. The spray base 78 is suitably mounted on the horizontal portion 38 of the floor panel which underlies the wash compartment 24.

Figure 3:
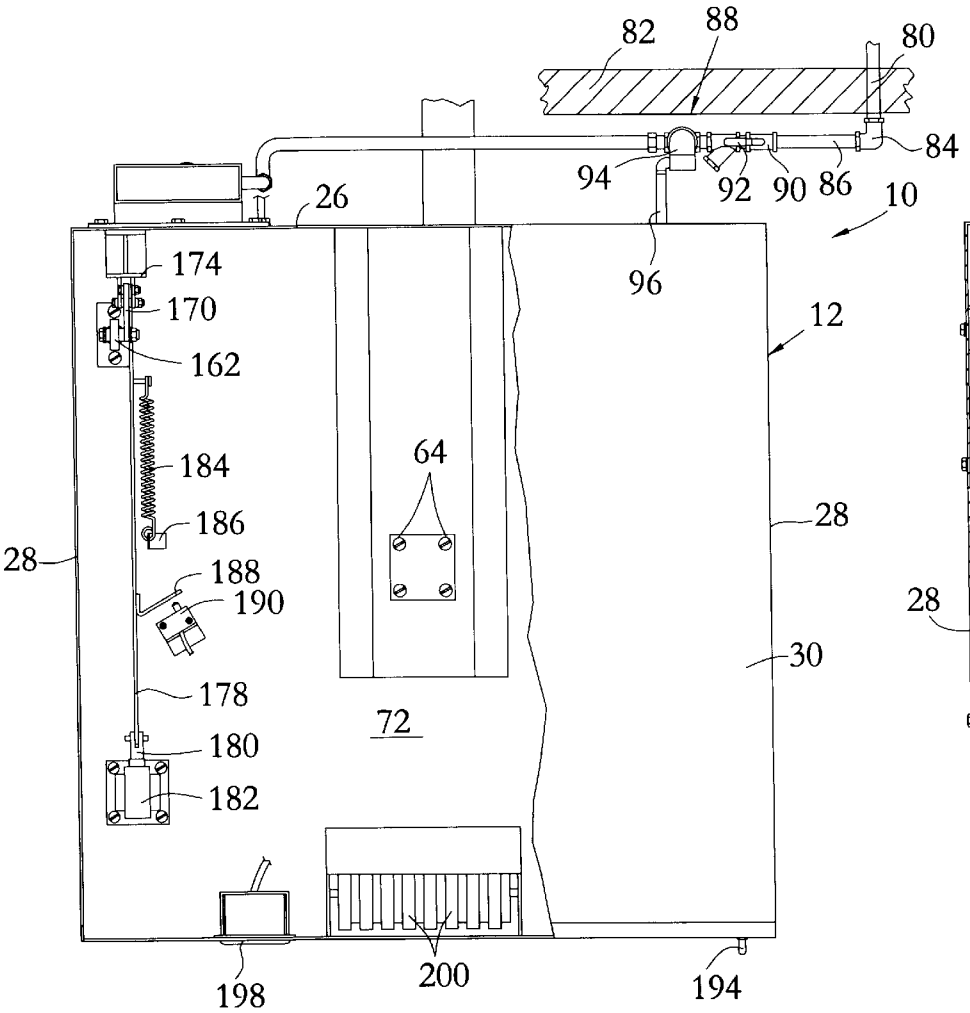
FIG. 3 is a top plan view of the machine, with a portion of the top panel of the cabinet broken away for purposes of illustration.

With reference to FIG. 3 in particular, water for use by the machine 10 is supplied from a building water system which includes a supply pipe 80 terminating at a wall 82 which may be a building wall located a short distance behind the cabinet 12. The supply pipe 10 may be connected by an elbow 84 with a short pipe 86 which connects with a water manifold generally identified by numeral 88. The water manifold 88 includes a ball valve 90 having a manually operated control lever 92. The manifold 88 also includes a line filter and a solenoid valve 94. The manifold 88 may be strapped to or otherwise suitably anchored to the wall 82. Electrical wiring for the solenoid valve extends within a flexible electrical conduit 95.

The outlet end of the manifold 88 connects with an elongated flexible hose 96. The hose 96 and the electrical conduit 95 should be long enough to allow the plumbing and electrical connections to be made before the dish washing machine 10 is installed under the counter. As best shown in FIG. 1, the flexible supply hose 96 extends to connection with a U-shaped pipe 97 which extends into an inlet fitting 98 secured to the back panel 26 of the cabinet. With additional reference to FIGS. 5 and 6, a coupling 100 is used to secure the pipe 97 with a short conduit 102 which extends within the fitting 98. The fitting 98 applies the incoming water to the wash compartment 24 through an inlet opening 104 formed in the cabinet back panel 26. A baffle 106 is located adjacent to the inlet opening 104 within the cabinet 12 in order to direct the incoming water generally downwardly toward the flat panel 38.

The water which is sprayed from the spray arm 48 and 50 and the water which is supplied to the machine through the inlet fitting 98 collects in a rectangular basin 108 and an underlying cylindrical sump 110. The basin 108 is located at a level below the floor panel 38 in the back corner of the machine. The sump 110 is secured to the bottom of the basin 108, and the sump and basin have a common opening so that water which enters the basin 108 falls into the underlying sump 110.

Figure 6:
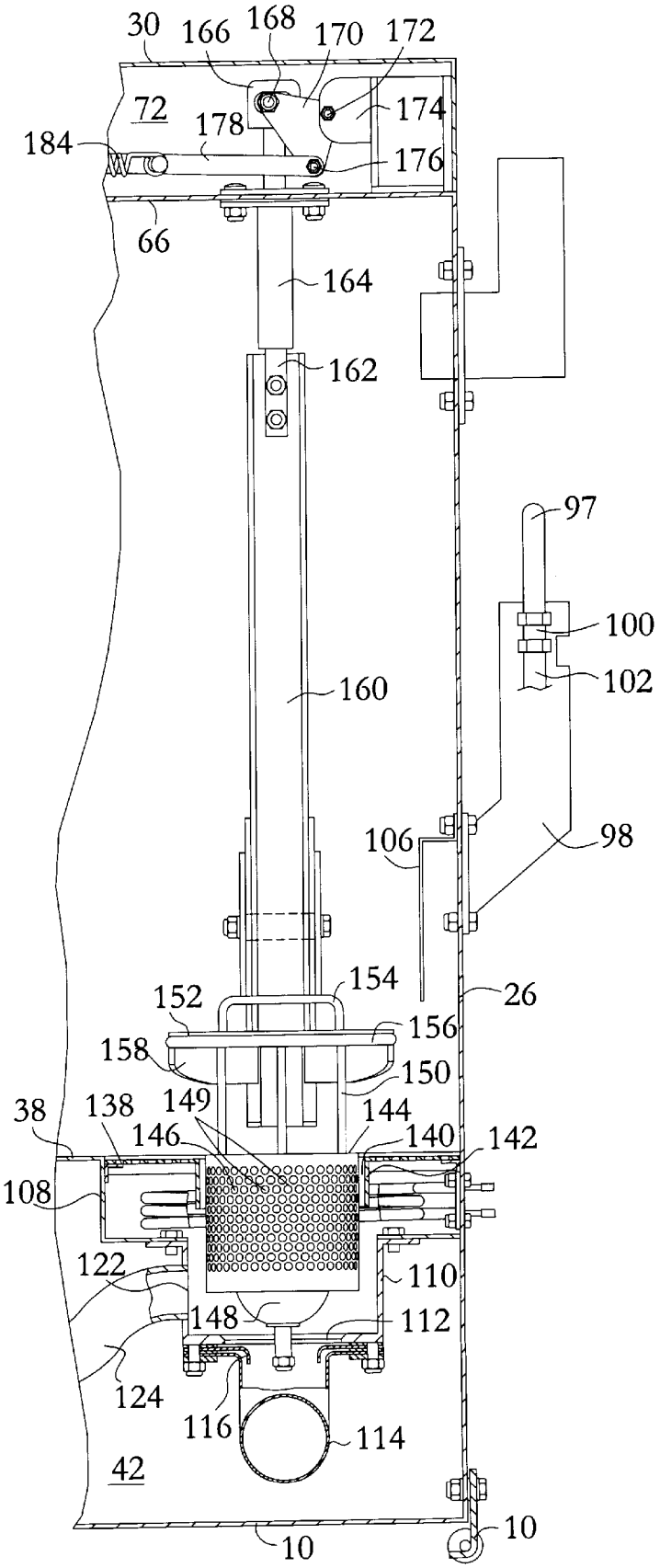
FIG. 6 is a fragmentary sectional view similar to FIG. 5 on an enlarged scale and showing the pump filter unseated from the drain opening to open the drain.

As best shown in FIG. 6, the bottom of the sump 110 is provided with a drain opening 112. The drain opening 112 leads to a drain pipe 114 which may be connected with the drain system of the building in which the machine is installed. A seat 116 for closing the drain opening 112 is provided by an annular member having a down turned lip on its inside edge.

Figure 5:
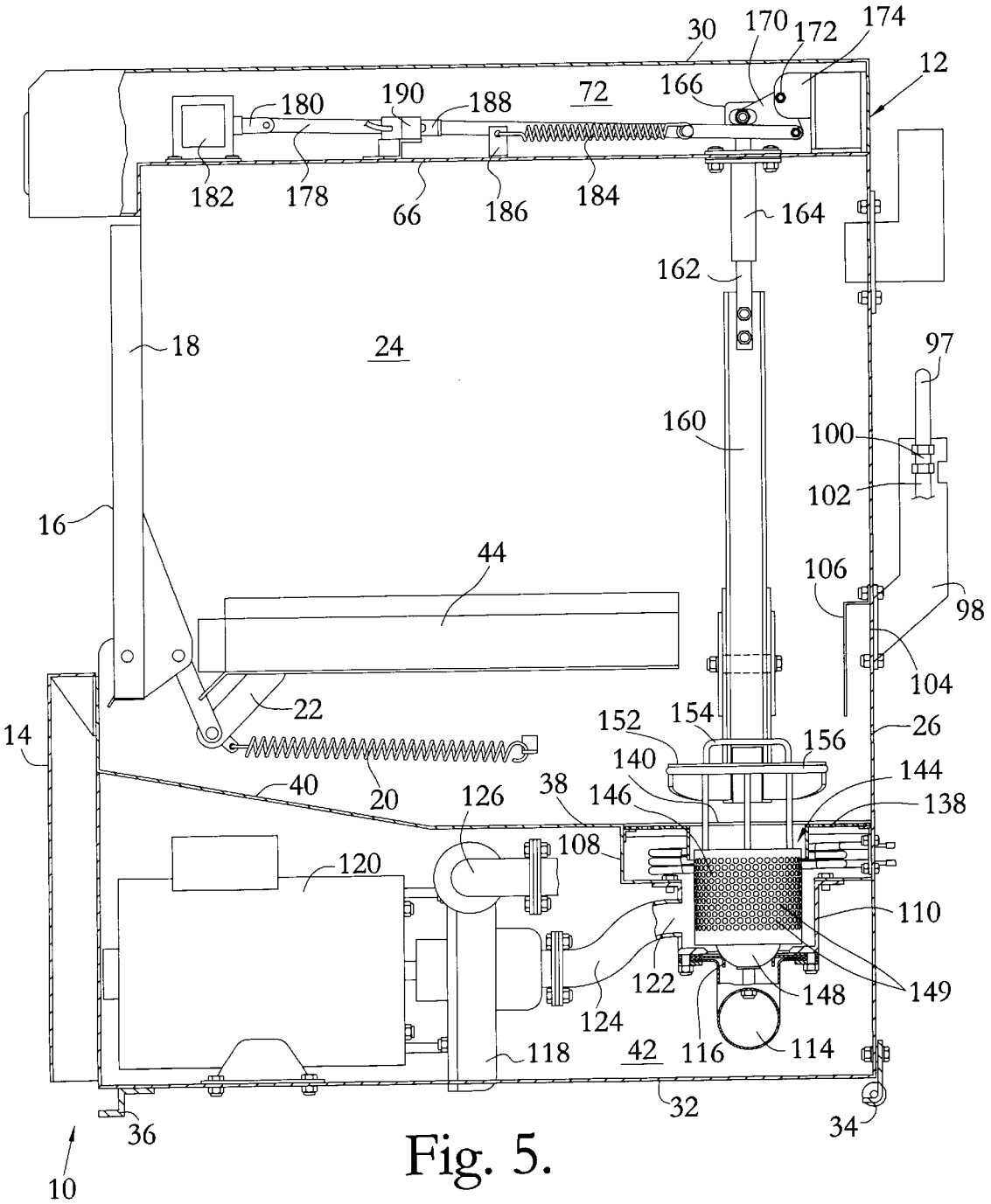
FIG. 5 is a sectional view on an enlarged scale taken generally along line 5—5 of FIG. 1 in the direction of the arrows and showing the pump filter seated to close the drain opening.

The water which collects in the sump 110 is pumped to the spray arms 48 and 50 by a pump 118 driven by an electric motor 120 (see FIG. 5). The side of the sump 110 is provided with a pump intake port 122 which is located above the bottom of the sump. The intake port 122 connects with a pipe 124 which extends to connection with the intake side of the pump 118.

The pump 118 and motor 120 are mounted within the pump housing 42. The pump 118 has a discharge pipe 126 which connects with another pipe 128 (see FIG. 2) extending within the pump housing. Pipe 128 turns upwardly and connects with a T-fitting 130 that extends into the wash compartment 24. The side outlet from the T-fitting 130 connects with a horizontal pipe 132 that extends to the lower spray base 78. The upper outlet of the T-fitting 130 connects with a vertical pipe 134 which extends upwardly into the recess 58 located at the top of the machine. The pipe 134 turns through a 90° angle and has a horizontal portion 136 which extends within the recess 58 and connects to the upper spray block 56.

Figure 4:
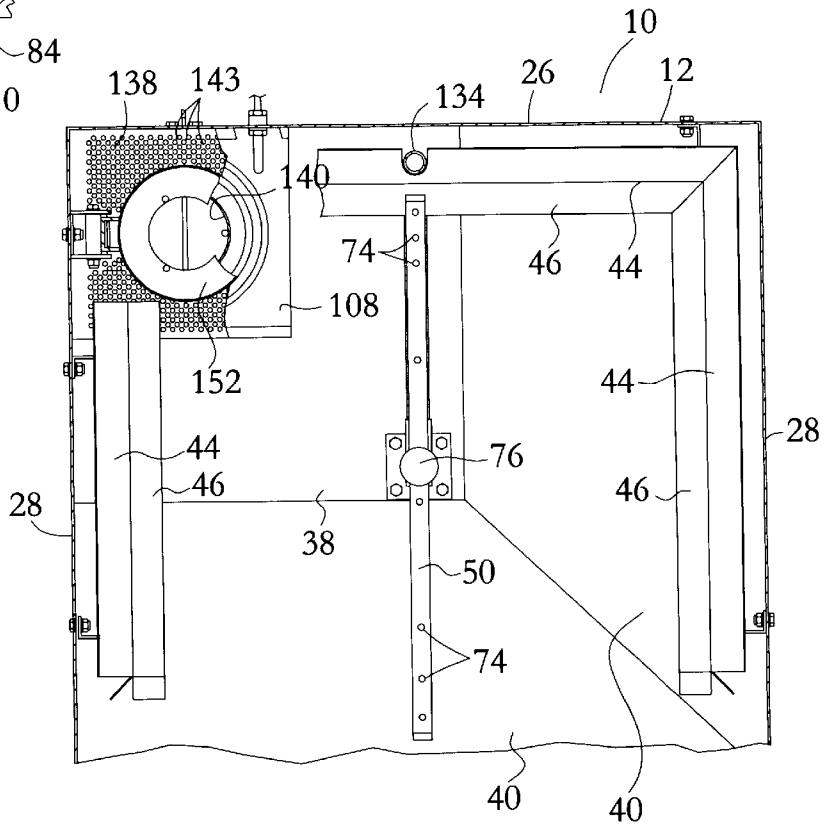
FIG. 4 is fragmentary sectional view taken generally along line 4—4 of FIG. 1 in the direction of the arrows.

A flat screen 138 covers the top of the basin 108. The screen 138 is removable and is provided at its center with a circular opening 140. A solid collar 142 extends downwardly from screen 138 around the opening 140. The screen 138 has a plurality of relatively small screen openings 143 (FIG. 4).

As best shown in FIG. 6, a pump filter which is generally identified by numeral 144 has a cylindrical body 146 which is perforated. The open interior of the body 146 is open at the top and closed at the bottom. On its bottom end, the pump filter 144 carries a semi-spherical plug 148 which normally seats on the seat 116 to close the drain opening 112. The body 146 presents relatively large perforations 149 in its side surface. For example, the perforations 149 may be about 0.19 inch in diameter as compared with a typical filter mesh of 0.092.

A plurality of rods 150 extend upwardly from the body 146 and connect with a flat ring 152. A handle 154 is provided above the ring 152 to allow the pump filter 144 to be lifted and removed from the machine when desired.

The pump filter 144 is normally supported on a circular hoop 156 on which ring 152 rests. The hoop 156 has a larger diameter than body 146 to allow the filler body to be lifted through the hoop. The hoop 156 connects with a bracket 158 which is connected with the lower end of a vertical bar 160. The bar 160 extends within the wash compartment 24 and connects at its top end with another bar 162 that slides within a guide 164. The guide 164 has a top flange which is bolted or otherwise secured to the underside of panel 66.

Rod 162 can slide up and down within the guide 164. Rod 162 extends into the control housing 72 and carries on its top end a plate 166 having an elongated opening that receives a bolt 168. The bolt 168 pivotally extends through one corner of a triangular link 170. Another corner of the link 170 is pivoted at 172 to a fixed bracket 174 mounted within the control housing 72. The third corner of link 170 is pivoted at 176 to the back end of an arm 178 which extends forwardly from link 170 within the control housing 72.

As shown in FIG. 5, the forward end of arm 178 is pivoted to a short bar 180 extending from a solenoid 182 used to control draining of the water from the machine. When the solenoid 182 is deenergized, bar 180 projects outwardly in the position shown in FIG. 5. Through the arm 178 and the triangular link 170, rod 162 and bar 160 are maintained in their lowermost positions. The hoop 156 is thus in its lowermost position, and the plug 148 seats securely on seat 116 to close the drain opening 112 in the position of FIG. 5.

A tension spring 184 is hooked at one end to arm 178 and at the opposite end to a bracket 186 secured to panel 66. The tension spring 184 thus urges arm 178 to the left as viewed in FIG. 5. When solenoid 182 is energized, the spring 184 pulls arm 178 to the left, and this in turn pivots the triangular link 170 clockwise about pin 172 to the position shown in FIG. 6. Rod 164 and bar 160 are pulled upwardly to pull the hoop 156 upwardly. The hoop lifts ring 152 and raises the pump filter 144 to the raised position shown in FIG. 6, where the plug 148 is unseated from the seat 116 to open the drain opening 112.

It is noted that the perforated body 146 of the pump filter operates within the collar 142. Water flowing through the opening 140 must pass through the perforations 149 of the body 146 in order to enter the sump 110 whether the pump filter is in the seated position of FIG. 5 or the unseated position of FIG. 6. Consequently, all the water that reaches the pump or the drain must pass through either the openings 143 of the screen 138 or the perforations of the pump filter body 146.

With particular reference to FIGS. 3 and 5, one side of the arm 178 is provided with a projecting bracket 188. A plunger switch 190 is secured on top of the panel 66 at a location adjacent to the bracket 188. When the solenoid 182 is deenergized and the pump filter is seated to close the drain opening 112, the bracket 188 is displaced slightly to the rear of the actuating button of the switch 190. However, when solenoid 182 is energized and spring 184 pulls the arm 178 forwardly, bracket 188 then depresses the button of the switch 190, and this assures deenergization of the pump motor as will be explained more fully.

As best shown in FIG. 1, the front of the control compartment 72 is provided with a control panel 192 having a plurality of switches 194 and indicator lights 196. A temperature gauge 198 may also be provided on the control panel 192. As shown in FIG. 3, the control compartment 72 may house a plurality of motor driven cams 200 located behind the center portion of the control panel 192.

Figure 7:
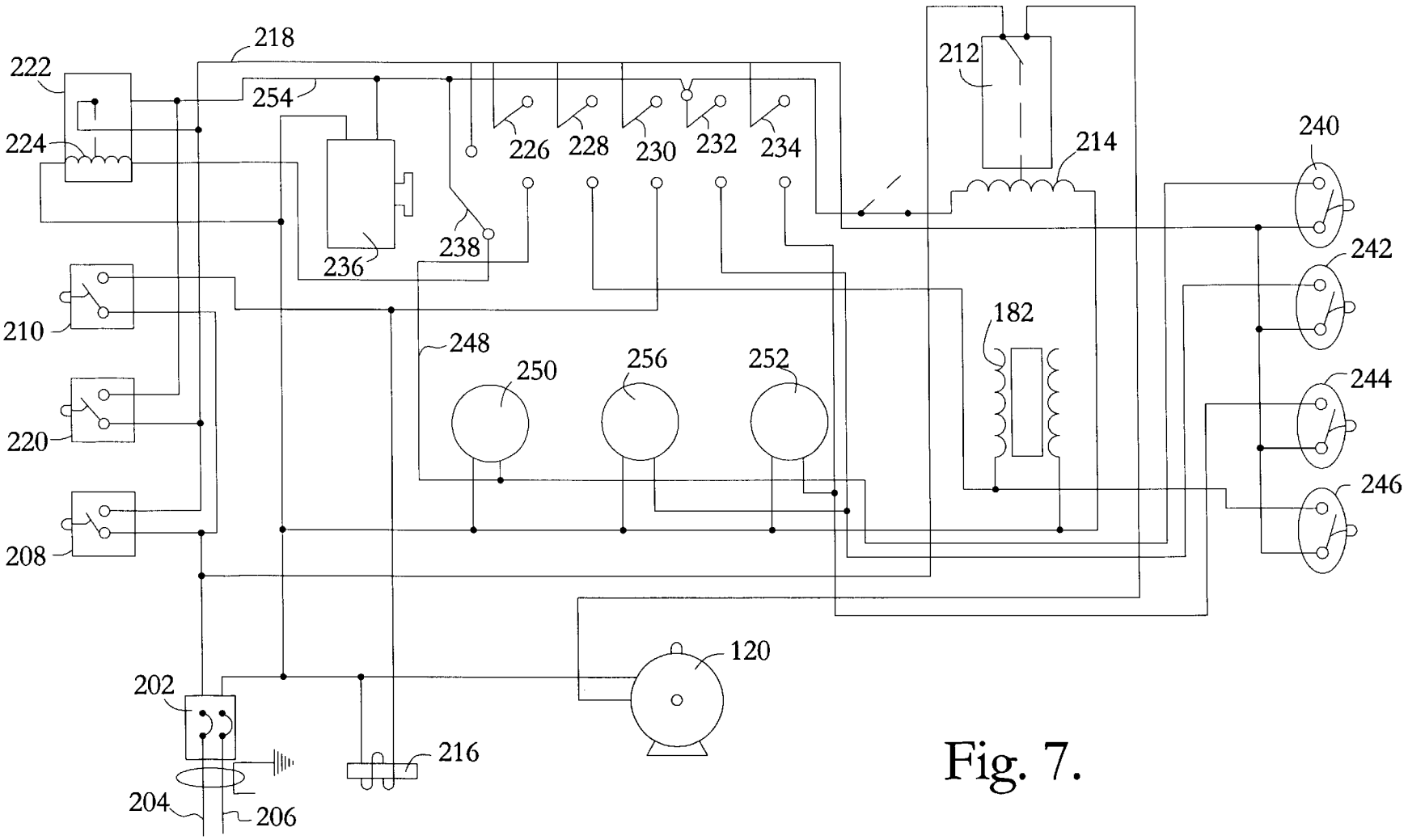
FIG. 7 is a circuit diagram of the control circuitry of the dish washing machine.

The electrical circuitry for controlling operation of the machine 10 is shown in FIG. 7. Incoming electrical power is applied to a master switch 202 from the building power system which includes a hot line 204 and a neutral line 206. Line 204 connects through the master switch 202 with one side of a door switch 208, one side of fill switch 210 and one side of a relay contact 212 forming part of a mercury relay which includes a relay coil 214. The door switch 208 is closed whenever the machine door 18 is closed and is open whenever the door is open. The fill switch 210 is a momentary push button switch that must be depressed and maintained in a depressed position in order to remain closed. If the fill switch is not depressed, it is open. The other side of the fill switch 210 connects through a water solenoid 216 with the neutral line 206. The solenoid 216 opens the solenoid valve 94 when energized and maintains valve 94 closed when deenergized.

The side of the door switch 208 opposite the side that connects with the power line 204 is connected with a conductor 218 that extends to one side of a start switch 220. Line 218 also supplies power to the normally open contacts of an instant start relay 222 having a relay coil 224 that closes the contacts when energized. Line 218 also supplies power to a series of normally open cam operated switches, including switch 226 used for application of detergent, switch 228 which opens the drain, switch 230 used to control the filling of the machine with water, switch 232 which is used for the application of sanitizing chemicals, and switch 234 which is used during the rinse cycle of the machine. A cam timer motor 236 controls the switches 226–234 as well as a normally closed on/off switch 238.

Line 218 also supplies power to one side of a detergent prime switch 240, a sanitization prime switch 242, a rinse prime switch 244 and a drain switch 246. The switches 240–246 are toggle switches that can be opened or closed as desired.

When the detergent application switch 226 is moved to the closed position by the cam timer motor 236, power is supplied from line 218 through switch 226 to a conductor 248 leading to a detergent pump 250. Power can also be supplied to pump 250 through line 248 when the switch 240 is closed. The opposite side of the pump 250 connects with the neutral line 206 through the master switch 202.

When the drain switch 228 is cammed to the closed position, it supplies power from line 218 to the drain solenoid 182. Power can also be supplied to the drain solenoid by switch 246 when it is closed. The opposite side of the drain solenoid 182 connects with the neutral line 206 through the master switch 202.

When the fill switch 230 is cammed to the closed position, power is supplied from line 218 through switch 230 to the water solenoid 216. When the rinse switch 234 is cammed to the closed position, power is supplied through it from line 218 to a rinse pump 252 which may also be energized by closing of the switch 244. The opposite side of the rinse pump 252 connects with the neutral line 206 through the master switch 202.

One side of the start switch 220 connects with a conductor 254 that supplies power to the cam timer motor 236. The opposite side of motor 236 connects with the neutral line 206 through the master switch. Line 254 also connects with the on/off switch 238 through which line 254 is connected with the relay coil 224 in the normal position of switch 238 which is shown in FIG. 7. The opposite side of the coil 224 connects with the neutral line through the master switch 202.

The cam timer motor 236 shifts the on/off switch 238 to an alternative position in which it connects lines 218 and 254. Line 254 connects with switch 232 and through switch 190 with the mercury relay coil 214, the opposite side of which connects with the neutral line through master switch 202. When switch 232 is cammed to its closed position, line 254 is connected through it with one side of a sanitizing pump 256. Power is also supplied to the sanitizing pump 256 when the switch 242 is closed. The opposite side of pump 256 connects with the neutral line through the master switch 202.

When the relay contacts 212 of the mercury relay are closed due to energization of coil 214, power is supplied through the contacts 212 to the wash pump motor 120 to pump water to the spray arms 48 and 50.

In use, dishware is loaded into a suitable rack (not shown) which is held on the lips 46 of the rack supports 44. In order to operate the machine for washing of the dishware, the door 18 must be closed in order to close the door switch 208 and apply power to line 218. The start switch 220 is then depressed momentarily to apply power to line 254 through the door switch 208 and the start switch 220, thus energizing the relay coil 224 through the on/off switch 238. The contacts of the start relay 222 are then closed so that power is applied through the door switch 208 and the relay contacts to line 254 for continued energization of the cam timer motor 236 after the start switch 220 is released. Motor 236 then operates to cam the on/off switch 238 to a position connecting line 218 with line 254 to thereafter provide power to motor 236 even though the relay coil 224 is deenergized to open the contacts of relay 222.

Application of power to line 254 energizes the mercury relay coil 214 so that the contacts 212 are closed and power is applied to motor 120 which then pumps water to the spray arms 48 and 50 during the wash cycle of the machine. Switch 226 is cammed by the operation of the cam motor 236 to the closed position, and the detergent pump 250 is then energized to add detergent to the wash compartment 24 during the wash cycle. It is noted that water that remains in the basin of the machine following the end of the previous cycle is used as the wash water for the next cycle.

At the end of each wash cycle, the drain switch 228 is cammed to its closed position. This energizes the drain solenoid 182 and lifts the pump filter 144 through the linkage provided by the arm 178, the link 170 and the bars 162 and 160. The plug 148 is then unseated so that the water within the wash compartment drains out through the basin 108 and the sump 110 to the drain line 114. When the drain solenoid 182 is energized, the button of switch 190 is depressed by bracket 188, thus opening switch 190 to deenergize the mercury relay coil 214 and stop motor 120 due to the opening of the relay contacts 212.

At the end of the drain cycle, switch 228 opens to deenergize the drain solenoid 182 and the pump filter 144 is then lowered such that the plug 148 closes the drain opening 112. Bracket 188 is released from switch 190 so that switch 190 is closed. The fill switch 230 is then cammed to the closed position so that the water solenoid 218 is energized, thus opening solenoid valve 94 and applying water to the machine through hose 96 and the inlet fitting 98. When switch 232 is cammed to the closed position, sanitizing chemicals are added by the sanitizing pump 256. When the rinse switch 234 is thereafter cammed to the closed position, the rinse pump 252 is activated so that the dishware is rinsed and sanitized by the clean water that is applied during the fill cycle. The rinse water that is left over at the end of the rinsing operation is used as the wash water for the next wash cycle of the machine.

It is generally desirable to completely drain the machine at the end of the day or any other time when the machine is not expected to be used for an extended time. The machine can be drained by closing the drain toggle switch 246 to energize the drain solenoid 182 long enough to drain all of the water out of the sump. It is also noted that the solenoid valve 94 is closed at the end of each fill cycle so that the hose 96 is not subjected to constant water pressure as would be the case in the absence of the solenoid valve 94.

The next morning or whenever the machine is to be used again, the fill switch 210 can be depressed and held depressed to maintain the water solenoid 216 energized long enough to fill the machine to the desired level. The machine can then be operated as described. It is noted that the prime switches 240, 242 and 244 may be closed to prime the pumps 250, 256 and 252.

It is thus evident that the dish washing machine 10 operates in a reliable and effective manner for the washing of dishware. The provision of the recess 58 and the recessing of the spray base 56 within the recess 58 allows the top control compartment 72 to be used for the housing of the various control components rather than requiring them to be housed at the bottom portion of the machine. In operation of the machine with the plug 148 seated to close the drain opening 112, all of the water must pass through either the screen 138 or the perforated body 146 of the pump filter 144, so that larger food scraps and other materials are unable to reach the sump or the pump intake. Likewise, during the drain cycle when the pump filter 144 is lifted to the position shown in FIG. 6, all of the water must still drain through either the screen or the pump filter. The body 146 serves as a scrap basket which collects larger items such as glass, straws and the like. The pump filter can be lifted by means of the handle 154 to lift the body 146 through hoop 156 so that the scrap materials collected in the body 146 can be dumped.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. An under the counter dish washing machine comprising:

a cabinet presenting a wash compartment for receiving dishes, said cabinet having walls and a top and bottom;

an upper spray assembly for spraying liquid on to the dishes, said upper spray assembly including a spray arm and a spray base on which the spray arm is mounted for rotation and from which the spray arm is supplied with liquid;

an enclosed chamber in said cabinet adjacent the top thereof containing control components, said chamber having a recess therein opening into said wash compartment; and said spray assembly being mounted in said wash compartment with said spray base located in said recess and said spray arm located below and adjacent to said enclosed chamber.

2. A dish washing machine as set forth in claim 1, wherein said recess is located substantially midway along a side to side dimension of said cabinet.

3. A dish washing machine as set forth in claim 2, wherein said recess extends rearwardly from the location of said spray base and including a liquid supply pipe extending in said recess rearwardly of said spray base for supplying liquid to the spray base.

4. A dish washing machine as set forth in claim 1, including a source of water under pressure and a plumbing system for directing water from said source to said spray base, said plumbing system comprising:

a sump in said cabinet for collecting water sprayed on the dishes;

means for pumping the water from said sump to said spray base;

an inlet to said cabinet for receiving water and directing it into said sump;

an elongate hose having opposite ends, one of which connects with said inlet;

a manifold on the end of said hose opposite said one end, a valve on said manifold having an open condition supplying water from said source to said hose and a closed condition blocking flow into the hose from said source;

means for normally maintaining said valve in the closed condition; and means for selectively opening said valve to apply water to said cabinet.

5. A dish washing machine as set forth in claim 1, including:

a sump in said cabinet for collecting liquid sprayed in said wash compartment;

a drain in said sump for draining liquid therefrom;

pump means for pumping liquid from said sump to said spray arm;

a screen covering said sump and presenting a plurality of screen openings and a larger opening;

a filter having a perforated body and an open top, said filter being mounted in said larger opening for movement therein between a seated position and a raised position and effective in both positions to direct water entering said larger opening through said perforated body and into the sump;

a plug on said filter closing said drain in the seated position of the filter and opening said drain in the raised position of the filter; and means for moving said filter between the seated and raised positions.

6. An under-the-counter dish washing machine comprising:

a cabinet presenting a wash compartment for receiving dishes, said cabinet having walls and a top and bottom;

an upper spray assembly for spraying liquid on to the dishes, said upper spray assembly including a spray arm and a spray base on which the spray arm is mounted for rotation and from which the spray arm is supplied with liquid;

an enclosed chamber in said cabinet adjacent the top thereof containing control components, said chamber having a recess therein opening into said wash compartment;

said spray assembly being mounted in said wash compartment with said spray base in said recess and said spray arm below and adjacent to said enclosed chamber, said recess being located substantially midway along a side to side dimension of said cabinet and extending rearwardly from the location of said spray base; and a liquid supply pipe extending in said recess rearwardly of said spray base for supplying liquid to the spray base.

* * * * *